US009196209B2

(12) United States Patent
Yen

(10) Patent No.: US 9,196,209 B2
(45) Date of Patent: Nov. 24, 2015

(54) CHARGE RECYCLING CIRCUIT

(75) Inventor: Chih-Jen Yen, Hsinchu (TW)

(73) Assignee: NOVATEK Microelectronics Corp., Hsinchu Science Park, Hsin-Chu (TW)

( * ) Notice: Subject to any disclaimer, the term of this patent is extended or adjusted under 35 U.S.C. 154(b) by 981 days.

(21) Appl. No.: 13/345,748

(22) Filed: Jan. 8, 2012

(65) Prior Publication Data

US 2013/0038298 A1 Feb. 14, 2013

(30) Foreign Application Priority Data

Aug. 11, 2011 (TW) ..... 100128664 A

(51) Int. Cl.
*G09G 3/36* (2006.01)

(52) U.S. Cl.
CPC ..... *G09G 3/3685* (2013.01); *G09G 3/3614* (2013.01); *G09G 3/3688* (2013.01); *G09G 2310/0291* (2013.01); *G09G 2330/023* (2013.01)

(58) Field of Classification Search
CPC ..... G09G 3/36; G09G 3/3611; G09G 3/3614; G09G 3/3648; G09G 3/3685; G09G 3/3688; G09G 3/3696; G09G 2310/0243; G09G 2310/0291; G09G 2310/0294; G09G 2330/02; G09G 2330/021; G09G 2330/023
See application file for complete search history.

(56) References Cited

U.S. PATENT DOCUMENTS

| | | | | |
|---|---|---|---|---|
| 7,852,311 | B2 * | 12/2010 | Hashimoto | 345/100 |
| 2006/0071924 | A1 | 4/2006 | Svensson | |
| 2006/0227080 | A1 | 10/2006 | Huang | |
| 2007/0205970 | A1 * | 9/2007 | Tang et al. | 345/87 |
| 2009/0201283 | A1 * | 8/2009 | Inokuchi et al. | 345/212 |
| 2013/0021314 | A1 * | 1/2013 | Wu | 345/212 |

FOREIGN PATENT DOCUMENTS

| | | | |
|---|---|---|---|
| CN | 101154349 | A | 4/2008 |
| CN | 101329838 | A | 12/2008 |
| CN | 101339305 | A | 1/2009 |
| JP | 2000172231 | A | 6/2000 |
| JP | 4032539 | B2 | 1/2008 |
| TW | 200620221 | | 6/2006 |
| TW | 200826540 | | 6/2008 |
| TW | 200847098 | | 12/2008 |

* cited by examiner

*Primary Examiner* — Nathan Danielsen
(74) *Attorney, Agent, or Firm* — Winston Hsu; Scott Margo

(57) ABSTRACT

A charge recycling circuit is configured to recycle charges which are discharged by a driving circuit during a discharge period and provide the recycled charges for charging the driving circuit during a charge period. Power consumption in the driving circuit may thus be reduced.

8 Claims, 9 Drawing Sheets

CHARGE RECYCLING CIRCUIT

BACKGROUND OF THE INVENTION

1. Field of the Invention

The present invention is related to a charge recycling circuit, and more particularly, to a charge recycling circuit for recycling charges which are discharged by a driving circuit and providing the recycled charges for charging the driving circuit.

2. Description of the Prior Art

Liquid crystal display (LCD) devices, characterized in thin appearance, low power consumption and no radiation, have been widely used in electronic devices such as computers, mobile phones, and personal digital assistants (PDAs), etc. The amount of light transmission may be adjusted by changing the orientation of liquid crystal molecules, thereby enabling an LCD device to provide output light with various intensities, as well as red, green and blue light with various grayscales. An LCD device typically includes an LCD panel, a timing controller and a source driver. The timing controller is configured to generate data signal associated with display images, as well as control and timing signals for operating the LCD panel. The source driver is configured to generate driving signals of the LCD panel according to the data signals, the control signals and the timing signals.

Normally, the polarity of voltages applied to both sides of a liquid crystal layer needs to be inverted periodically to avoid permanent damages to the liquid crystal layer due to polarization and to reduce image sticking. Common LCD driving methods include frame inversion, line inversion and dot inversion. Therefore, the source driver needs to perform charging and discharging operations periodically for altering the polarity of the driving signals. Meanwhile, the output of the timing driver also needs to be switched between logic 1 and logic 0.

FIG. 1 is a diagram of a prior art driving circuit 10. The driving circuit 10 may be a source driver of an LCD device for converting an input voltage $V_{IN}$ into a plurality of output voltages $V_{OUT1}$~$V_{OUTN}$. OP_O represents the unit gain buffer of all odd-numbered output channels, while OP_E represents the unit gain buffer of all even-numbered output channels (assuming N is a positive even number). The unit gain buffers OP_O and OP_E, coupled to a bias voltage VDD provided by a power supply, may be charged by the bias voltage VDD or discharged to a ground GND, thereby providing corresponding output voltages $V_{OUT1}$~$V_{OUTN}$.

FIGS. 2A and 2B are signal diagrams of the prior art driving circuit 10 in operation. FIG. 2A illustrates the output waveforms of the unit gain buffers OP_O and OP_E when driven in a full-swing manner in which odd-numbered output voltages (the output voltage $V_{OUT1}$ as an example) and even-numbered output voltages (the output voltage $V_{OUT2}$ as an example) have opposite polarities during the same period. FIG. 2B illustrates the output waveforms of the unit gain buffers OP_O and OP_E when driven in a half-swing manner in which positive odd-numbered output voltages (the output voltage $V_{OUT1}$ as an example) and negative even-numbered output voltages (the output voltage $V_{OUT2}$ as an example) are provided during each period.

When operating the prior art driving circuit 10 in either full-swing or half-swing manner, the unit gain buffers OP_O and OP_E need to be charged by the bias voltage VDD for charging a loading capacitor and is configured to discharge the loading capacitor to the ground GND, thereby consuming a lot of power.

SUMMARY OF THE INVENTION

The present invention provides a charge recycling circuit for charging a driving circuit using charges which are discharged from the driving circuit. The charge recycling circuit includes a first node coupled to a first charging path and a second charging path of the driving circuit; a second node coupled to a first discharging path and a second discharging path of the driving circuit; a first capacitor coupled between the first node and the second node; and a switch coupled to the second node and configured to operate according to a control signal.

The present invention also provides a charge recycling circuit for charging a driving circuit using charges which are discharged from the driving circuit. The charge recycling circuit includes a first node coupled to a charging path of the driving circuit; a second node coupled to a discharging path of the driving circuit; a capacitor coupled between the first node and the second node; and a switch coupled to the second node and configured to operate according to a control signal.

These and other objectives of the present invention will no doubt become obvious to those of ordinary skill in the art after reading the following detailed description of the preferred embodiment that is illustrated in the various figures and drawings.

DETAILED DESCRIPTION

Figure 1:
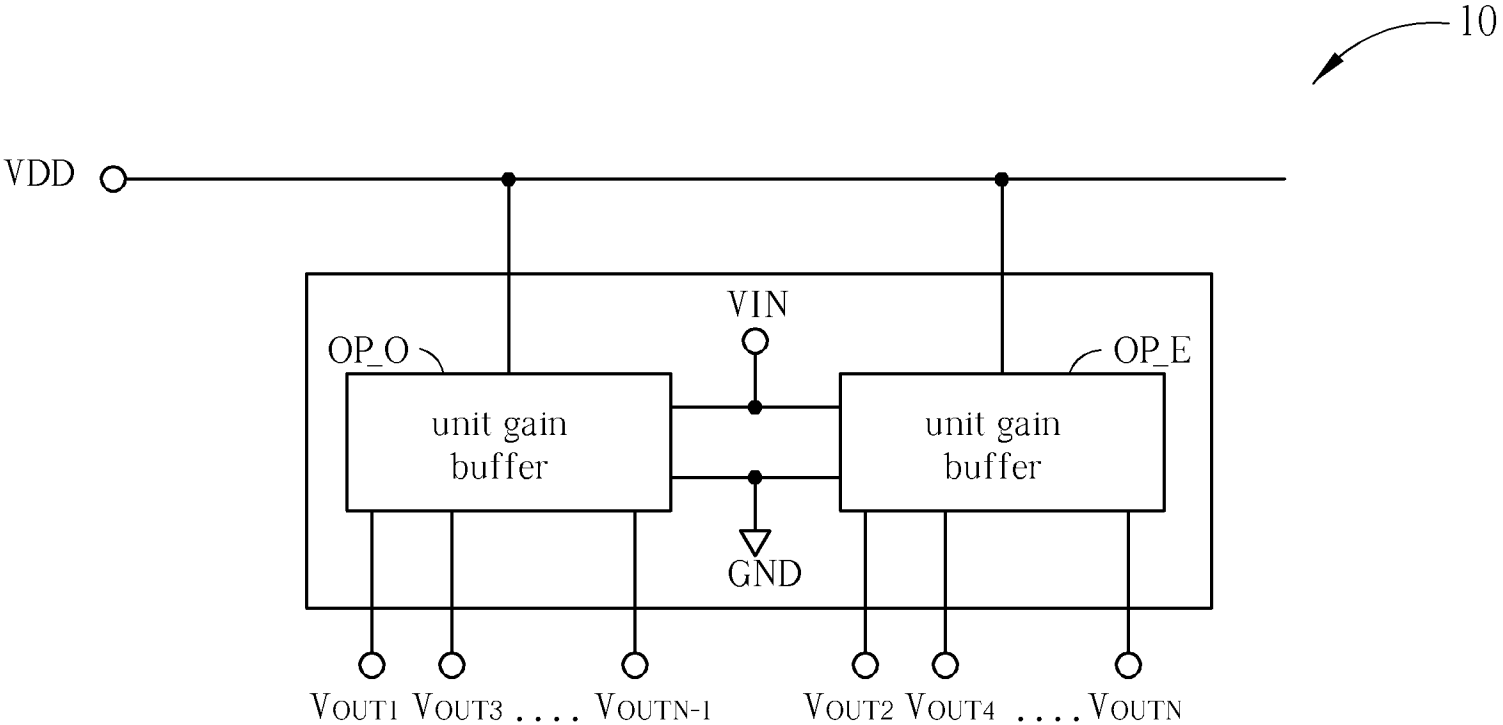
FIG. 1 PRIOR ART
FIG. 1 is a diagram of a prior art driving circuit.
Figure 2A:
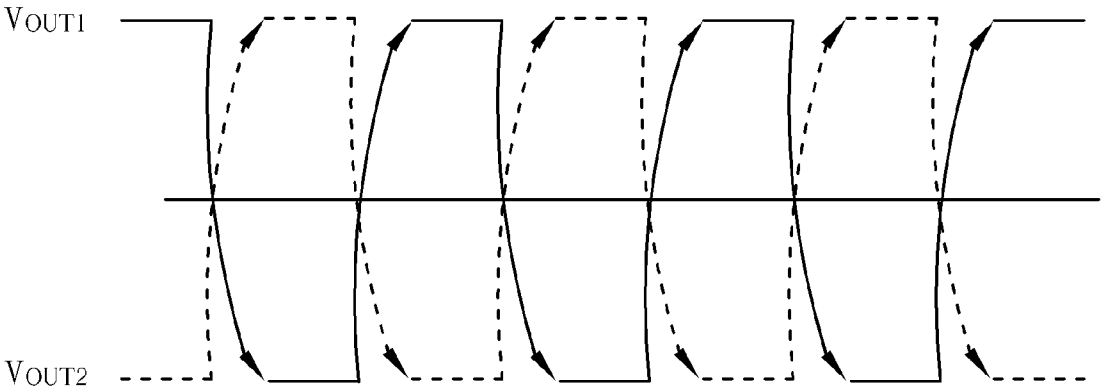
FIG. 2A PRIOR ART
FIGS. 2A and 2B are signal diagrams of a prior art driving circuit in operation.
Figure 2B:
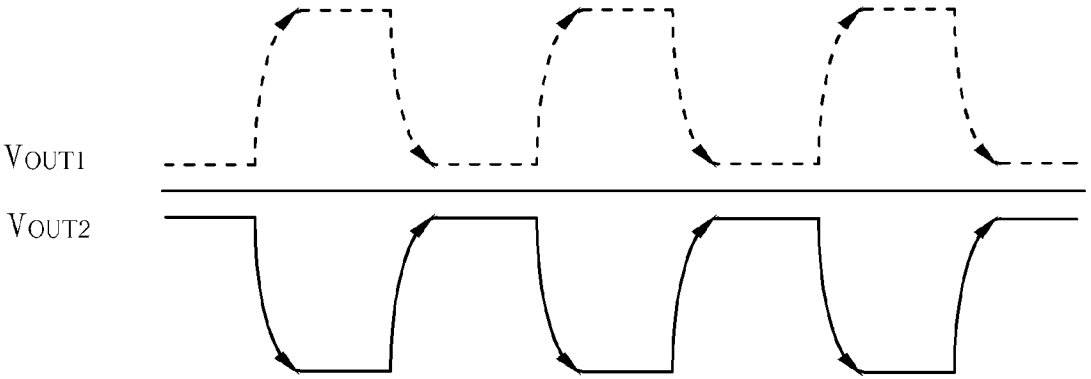
FIG. 2B PRIOR ART
Figure 3:
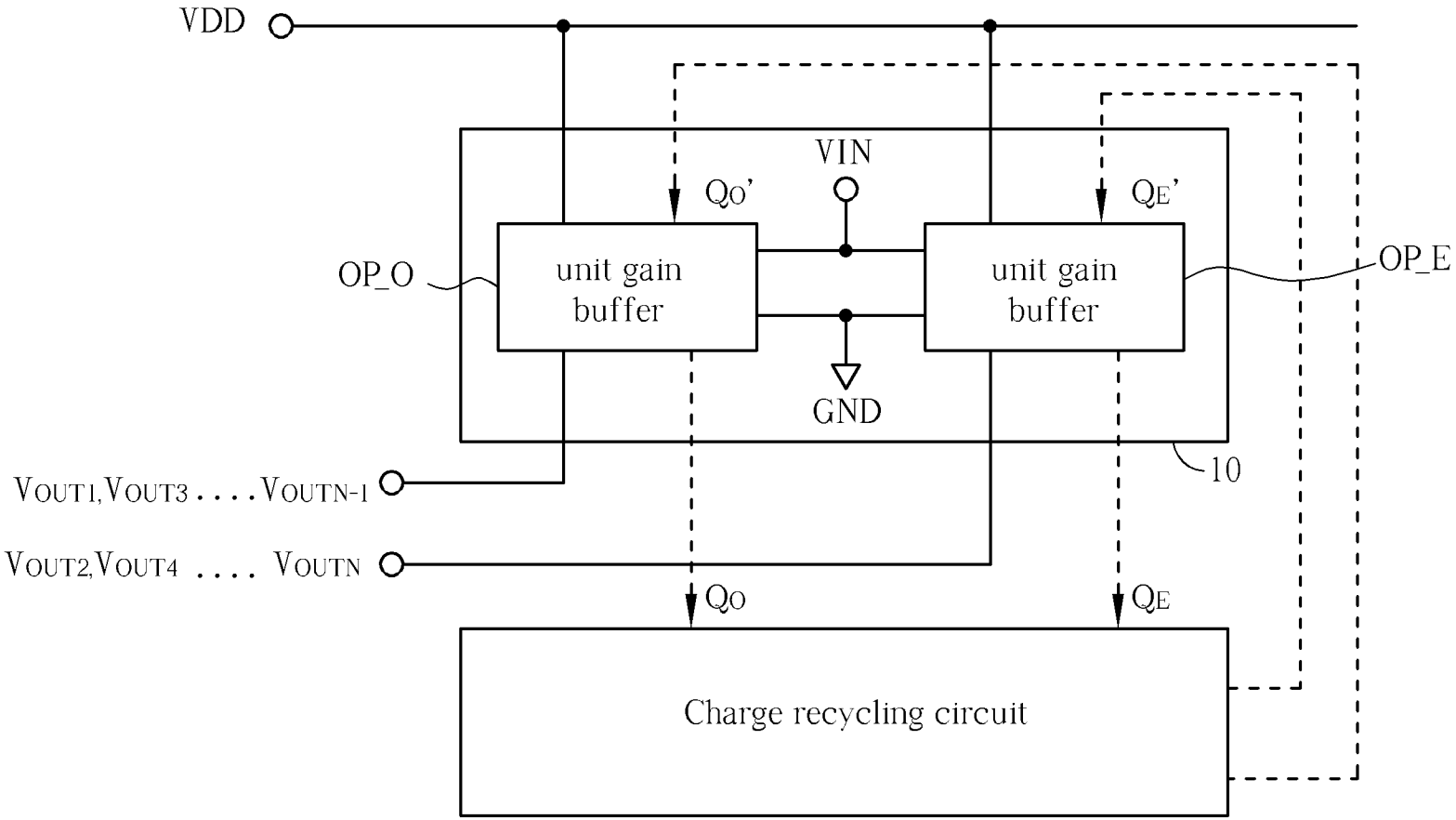
FIG. 3 is a functional diagram of a charge recycling circuit of the present invention for use in a driving circuit.

FIG. 3 is a functional diagram of a charge recycling circuit of the present invention for use in a driving circuit 10. The driving circuit 10 may be a source driver of an LCD device and configured to convert an input voltage $V_{IN}$ into a plurality of output voltages $V_{OUT}$~$V_{OUTN}$. OP_O represents the unit gain buffers of all odd-numbered output channels, while OP_E represents the unit gain buffers of all even-numbered output channels (assuming N is a positive even number). The charge recycling circuit of the present invention, coupled to the unit gain buffers OP_O and OP_E of the driving circuit 10, is configured to recycle charges $Q_O$ discharged from the unit gain buffer OP_O or charges $Q_E$ discharged from the unit gain buffer OP_E during a specific period, and configured to provide corresponding recycled charges $Q_O'$ or $Q_E'$ for charging the unit gain buffers OP_O and OP_E in a subsequent period. Therefore, the power consumption of the driving circuit 10 may be lowered.

In a first embodiment of the present invention, the charges $Q_O$ recycled from the unit gain buffer OP_O during the previous period may be used to charge the unit gain buffer OP_O during the current period, while the charges $Q_E$ recycled from the unit gain buffer OP_E during the previous period may be used to charge the unit gain buffer OP_E during the current period. If the amount of charges required to charge the unit gain buffer OP_O during the current period is less than the charges recycled from the unit gain buffer OP_O during the previous period ($Q_O' \leq Q_O$), the unit gain buffer OP_O does not need to be charged by the bias voltage VDD; if the amount of charges required to charge the unit gain buffer OP_O during the current period is more than the charges recycled from the unit gain buffer OP_O during the previous period, the unit gain buffer OP_O may further be charged by the bias voltage VDD. Similarly, if the amount of charges required to charge the unit gain buffer OP_E during the current period is less than the charges recycled from the unit gain buffer OP_E during the previous period ($Q_E' \leq Q_E$), the unit gain buffer OP_E does not need to be charged by the bias voltage VDD; if the amount of charges required to charge the unit gain buffer OP_E during the current period is more than the charges recycled from the unit gain buffer OP_E during the previous period, the unit gain buffer OP_E may further be charged by bias voltage VDD. Since the charges which are discharged during the previous period may be recycled for use in the current period, the unit gain buffer OP_O or OP_E does not need to be charged by the bias voltage VDD, or only needs to receive small amount of energy from the bias voltage VDD. Therefore, the first embodiment of the present invention may reduce power consumption of the driving circuit 10 effectively.

Figure 4:
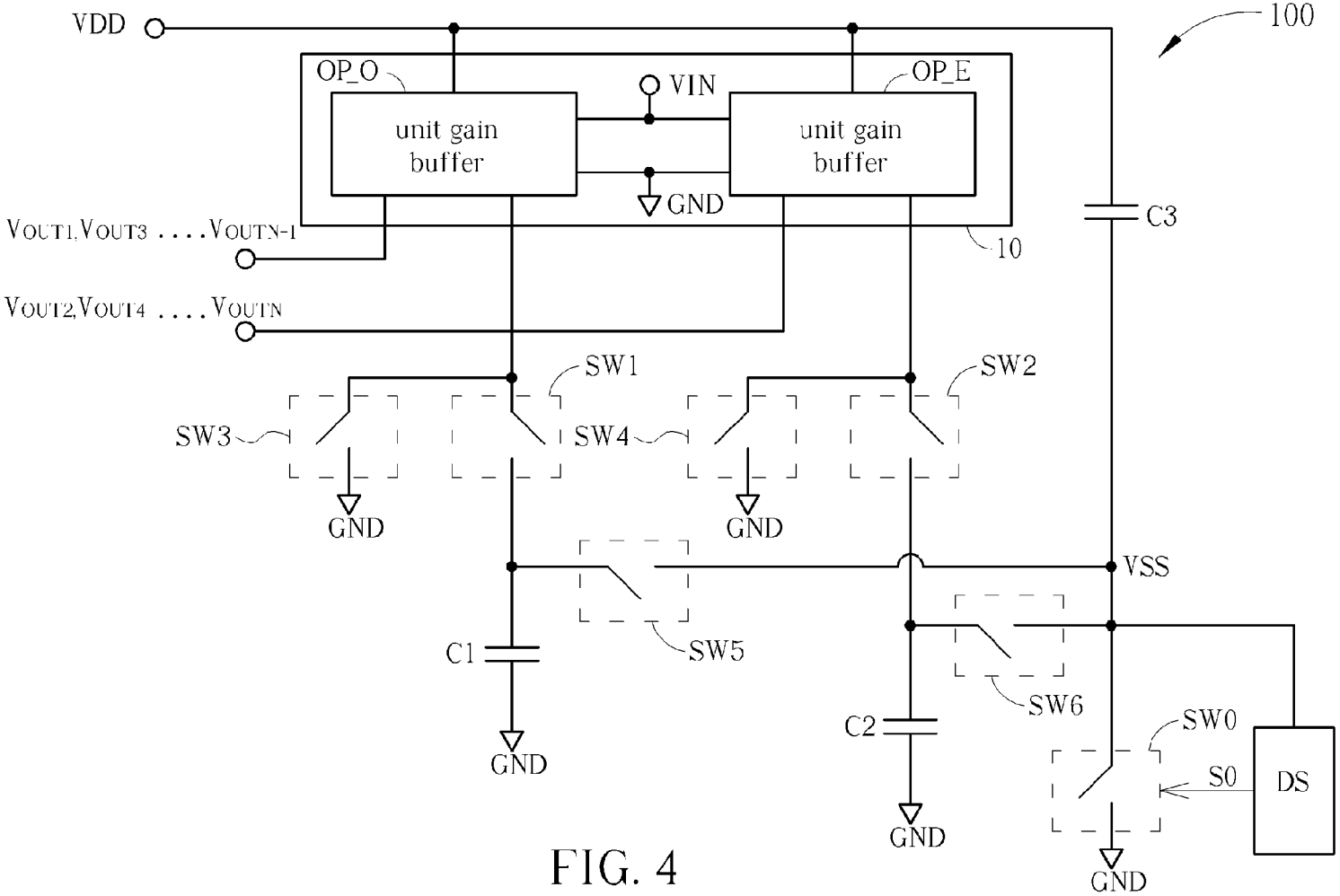
FIG. 4 is a diagram illustrating a charge recycling circuit according to an embodiment of the present invention.

FIG. 4 is a diagram illustrating a charge recycling circuit 100 according to the first embodiment of the present invention. The charge recycling circuit 100 includes capacitors C1~C3, switches SW0~SW6, and a detecting circuit DS. The switch SW0 is coupled between a node VSS and a ground GND. The switch SW1 is coupled between the unit gain buffer OP_O of odd-numbered output voltages and the capacitor C1. The switch SW2 is coupled between the unit gain buffer OP_E of even-numbered output voltages and the capacitor C2. The switch SW3 is coupled between the unit gain buffer OP_O and the ground GND. The switch SW4 is coupled between the unit gain buffer OP_E and the ground GND. The switch SW5 includes a first end coupled between the switch SW1 and the capacitor C1, and a second end coupled to a node VSS. The switch SW6 includes a first end coupled between the switch SW2 and the capacitor C2, and a second end coupled to the node VSS. The capacitor C3 is coupled between a node VDD and the node VSS. The detecting circuit DS is configured to generate a control signal S0 for operating the switch SW0 according to a voltage of the node VSS or a current flowing through the node VSS.

Figure 5:
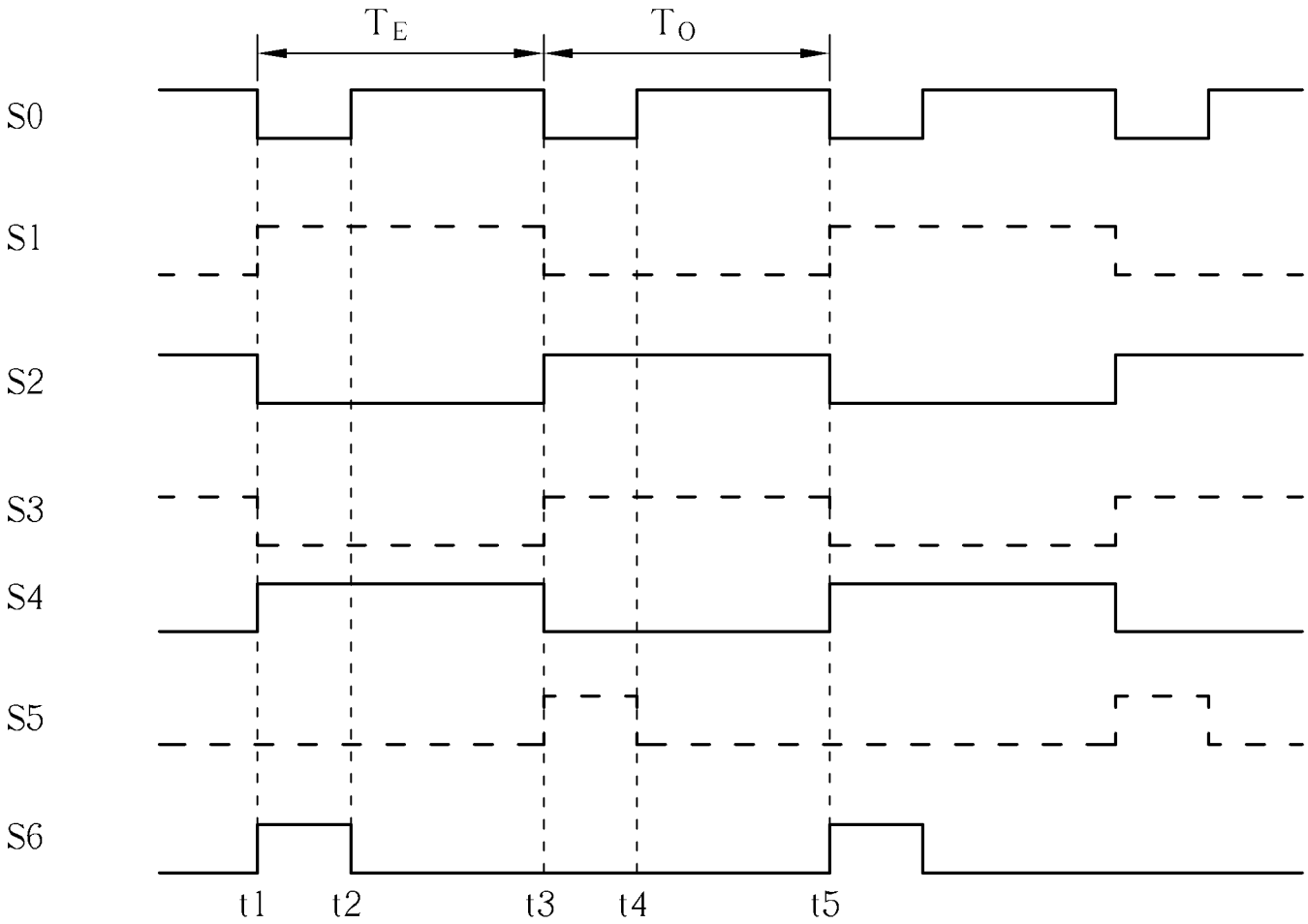
FIG. 5 is a timing diagram illustrating the operation of a charge recycling circuit according to an embodiment of the present invention.

FIG. 5 is a timing diagram illustrating the operation of the charge recycling circuit 100 according to the first embodiment of the present invention. In FIG. 5, S0~S6 represent the control signals of the switches SW1~SW6, respectively. For ease of illustration, it is assumed that the switches SW1~SW6 are turned on (short-circuited) when the control signals S0~S6 are at high level and turned off (open-circuited) when the control signals S0~S6 are at low level. However, the control signals S0~S6 may be provided according to different types of the switches SW1~SW6. The embodiment depicted in FIG. 5 is only for illustrative purpose and does not limit the scope of the present invention.

FIGS. 6A~6D are equivalent circuits of the charge recycling circuit 100 in operation. During period $T_E$ which is the charging period of the unit gain buffer OP_E and the discharging period of the unit gain buffer OP_O, the switches SW1 and SW4 are turned on and the switches SW2 and SW3 are turned off, thereby coupling the unit gain buffer OP_O to the capacitor C1 and coupling the unit gain buffer OP_E to the ground GND. During period $T_O$ which is the charging period of the unit gain buffer OP_O and the discharging period of the unit gain buffer OP_E, the switches SW2 and SW3 are turned on and the switches SW1 and SW4 are turned off, thereby coupling the unit gain buffer OP_E to the capacitor C2 and coupling the unit gain buffer OP_O to the ground GND.

Figure 6B:
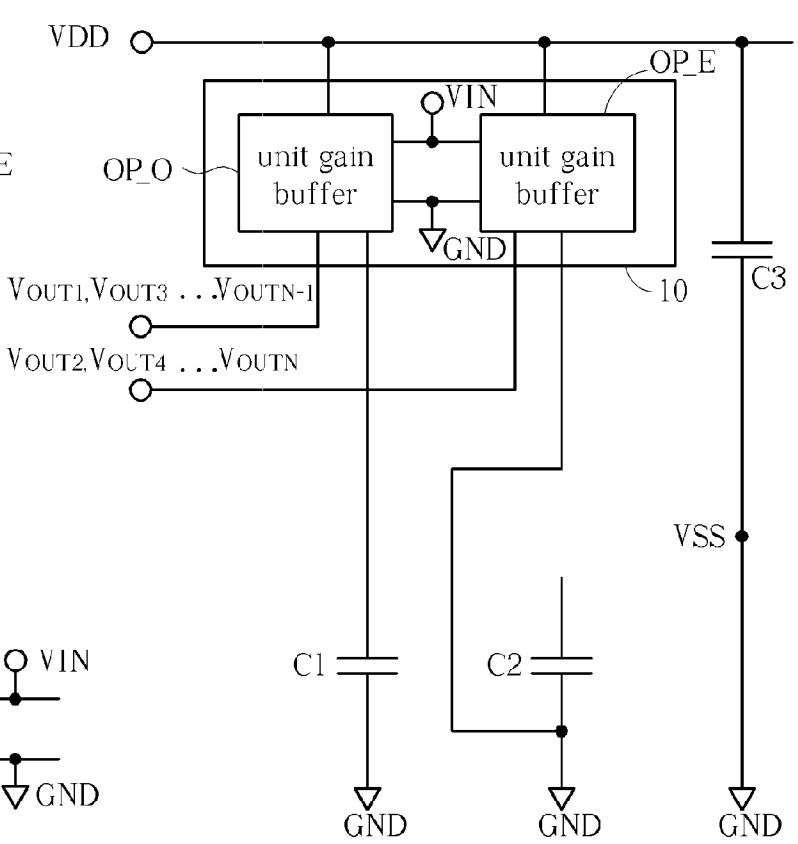
FIGS. 6A~6D are equivalent circuits of a charge recycling circuit in operation.
Figure 6A:
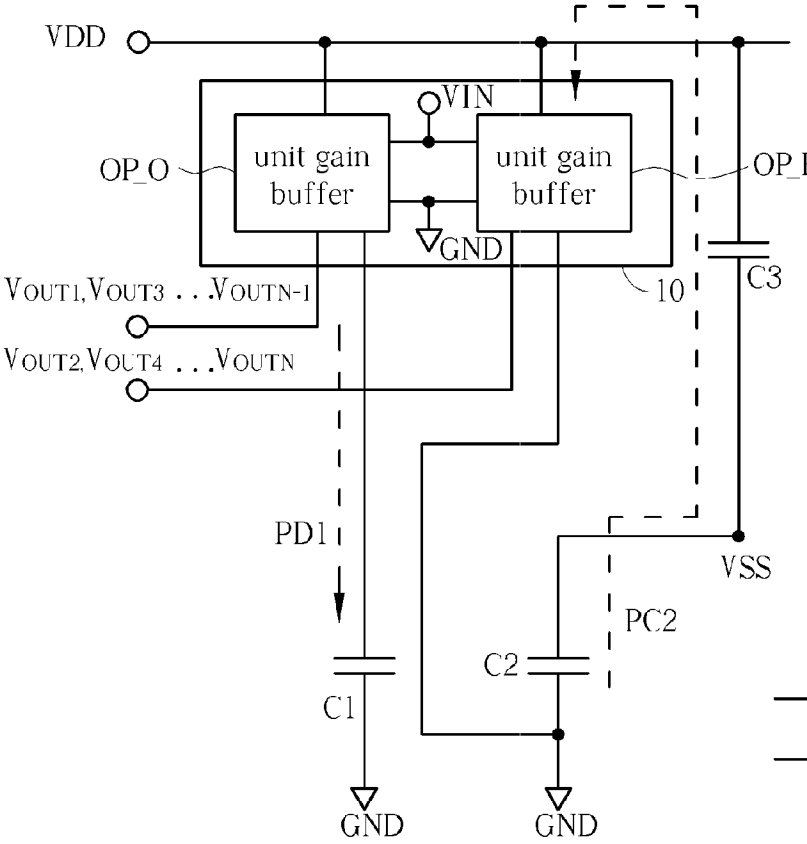

As depicted in FIG. 6A, the switches SW0 and SW5 are turned off and the switch SW6 is turned on between t1 and t2, and the capacitor C2 is thus coupled between the node VSS and the ground GND. Charges which are discharged from the unit gain buffer OP_O may be stored in the capacitor C1, while recycled charges stored in the capacitor C2 (i.e., charges which are discharged from the unit gain buffer OP_E during the previous period) may be transmitted to the unit gain buffer OP_E for charging the output voltage to a target level. In FIG. 6A, an arrow PD1 represents a first discharging path of the driving circuit 10, and an arrow PC2 represents a second charging path of the driving circuit 10.

As depicted in FIG. 6B, the voltage of the node VSS may fluctuate as the recycled charges stored in the capacitor C2 are transmitted to the unit gain buffer OP_E, thereby influencing system stability. If the detecting circuit DS detects that the voltage of the node VSS or the current flowing through the node VSS deviates from a predetermined value at t2, the control S0 may be switched to high level for turning on the switch SW0, and the control S6 may be switched to low level for turning off the switch SW6. Therefore, the node VSS may be coupled to the ground GND between t2 and t3.

Figure 6D:
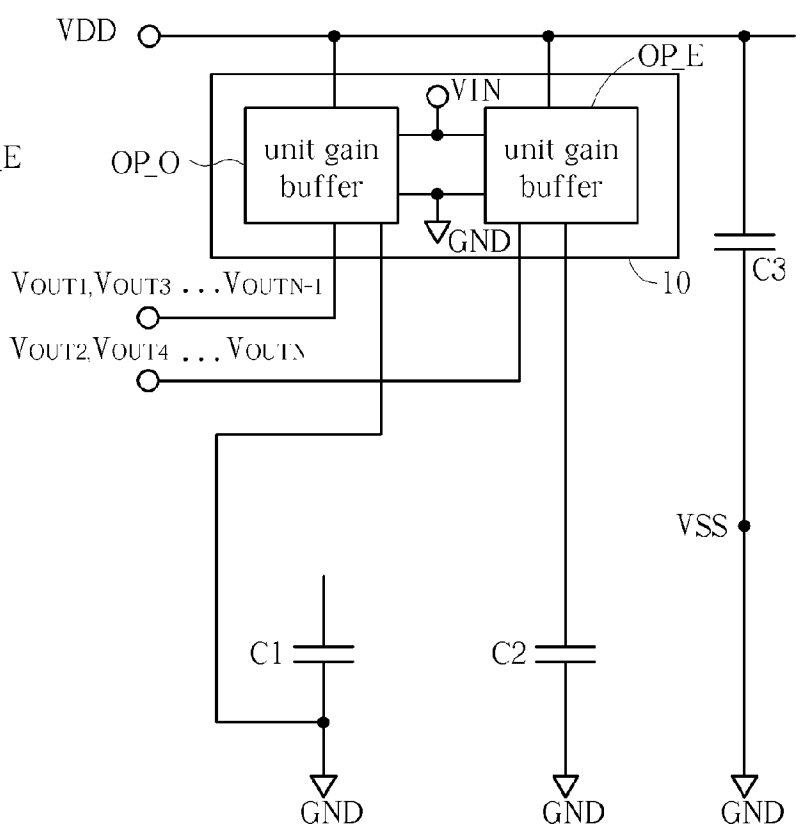
Figure 6C:
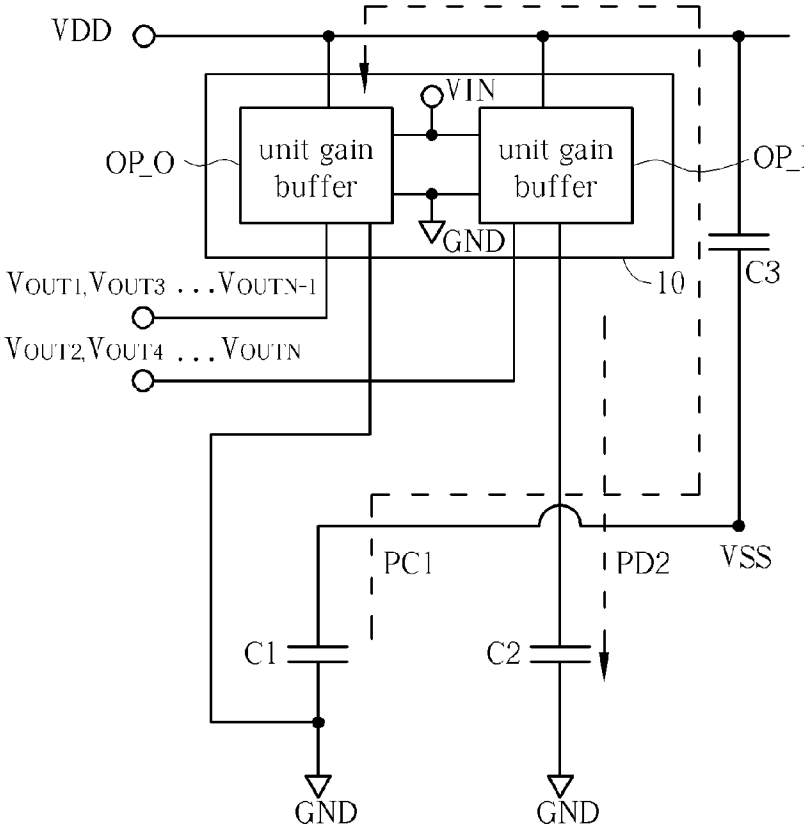

As depicted in FIG. 6C, the switches SW0 and SW6 are turned off and the switch SW5 is turned on between t3 and t4, and the capacitor C1 is thus coupled between the node VSS and the ground GND. Charges which are discharged from the unit gain buffer OP_E may be stored in the capacitor C2, while recycled charges stored in the capacitor C1 (i.e., charges which are discharged from the unit gain buffer OP_O during the previous period) may be transmitted to the unit gain buffer OP_O for charging the output voltage to a target level. In FIG. 6C, an arrow PD2 represents a second discharging path of the driving circuit 10, and an arrow PC1 represents a first charging path of the driving circuit 10.

As depicted in FIG. 6D, the voltage of the node VSS may fluctuate as the recycled charges stored in the capacitor C1 are transmitted to the unit gain buffer OP_O, thereby influencing system stability. If the detecting circuit DS detects that the voltage of the node VSS or the current flowing through the node VSS deviates from a predetermined value at t4, the control S0 may be switched to high level for turning on the switch SW0, and the control S5 may be switched to low level for turning off the switch SW5. Therefore, the node VSS may be coupled to the ground GND between t4 and t5.

In a second embodiment of the present invention, the charges $Q_O$ recycled from the unit gain buffer OP_O during the previous period may be used to charge the unit gain buffer OP_E during the current period, while the charges $Q_E$ recycled from the unit gain buffer OP_E during the previous period may be used to charge the unit gain buffer OP_O during the current period. If the amount of charges required to charge the unit gain buffer OP_O during the current period is less than the charges recycled from the unit gain buffer OP_E during the previous period ($Q_O \geq Q_E$), the unit gain buffer OP_O does not need to be charged by the bias voltage VDD; if the amount of charges required to charge the unit gain buffer OP_O during the current period is more than the charges recycled from the unit gain buffer OP_E during the previous period, the unit gain buffer OP_O may further be charged by the bias voltage VDD. Similarly, if the amount of charges required to charge the unit gain buffer OP_E during the current period is less than the charges recycled from the unit gain buffer OP_O during the previous period ($Q_E \geq Q_O$), the unit gain buffer OP_E does not need to be charged by the bias voltage VDD; if the amount of charges required to charge the unit gain buffer OP_E during the current period is more than the charges recycled from the unit gain buffer OP_O during the previous period, the unit gain buffer OP_E may further be charged by bias voltage VDD. Since the charges which are discharged during the previous period may be recycled for use in the current period, the unit gain buffer OP_O or OP_E does not need to be charged by the bias voltage VDD, or only needs to receive small amount of energy from the bias voltage VDD. Therefore, the second embodiment of the present invention may reduce power consumption of the driving circuit 10 effectively.

Figure 7:
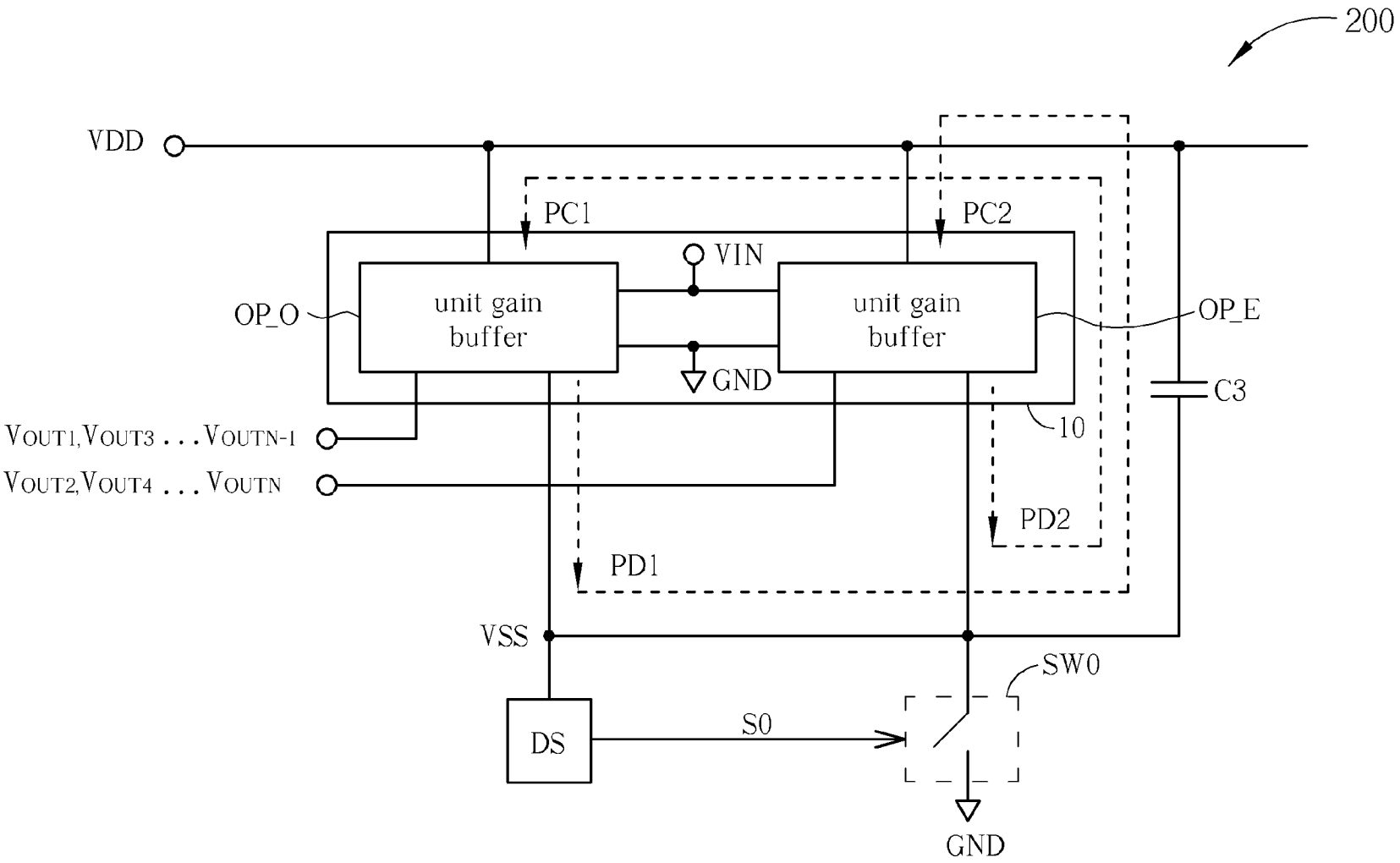
FIG. 7 is a diagram illustrating a charge recycling circuit according to an embodiment of the present invention.

FIG. 7 is a diagram illustrating a charge recycling circuit 200 according to the second embodiment of the present invention. The charge recycling circuit 200 includes a capacitor C3, a switch SW0, and a detecting circuit DS. The switch SW0 includes a first end coupled between the unit gain buffers OP_O and OP_E, and a second end coupled to a ground GND. The capacitor C3 includes a first end coupled to a bias voltage VDD, and a second end coupled to a node VSS. The detecting circuit Ds is configured to generate a control signal S0 for operating the switch SW0 according to a voltage of the node VSS or a current flowing through the node VSS.

As previously illustrated, the charging period of the unit gain buffer OP_E is the discharging period of the unit gain buffer OP_O, and the charging period of the unit gain buffer OP_O is the discharging period of the unit gain buffer OP_E. When the unit gain buffer OP_O starts charging operation and the unit gain buffer OP_E starts discharging operation, the switch SW0 of the charge recycling circuit 200 is turned off. Therefore, the charge recycling circuit 200 may recycle charges which are discharged from the unit gain buffer OP_E and transmit the recycled charges to the unit gain buffer OP_O for charging the output voltage to a target level. Similarly, when the unit gain buffer OP_E starts charging operation and the unit gain buffer OP_O starts discharging operation, the switch SW0 of the charge recycling circuit 200 is turned off. Therefore, the charge recycling circuit 200 may recycle charges which are discharged from the unit gain buffer OP_O and transmit the recycled charges to the unit gain buffer OP_E for charging the output voltage to a target level. If the detecting circuit DS detects that the voltage of the node VSS or the current flowing through the node VSS deviates from a predetermined value, the control S0 may be switched to high level for turning on the switch SW0, thereby coupling the node VSS to the ground GND for maintaining system stability. In FIG. 7, arrows PC1, PC2, PD1 and PD2 represent a first charging path, a second charging path, a first discharging path and a second discharging path of the driving circuit 10, respectively.

Figure 8:
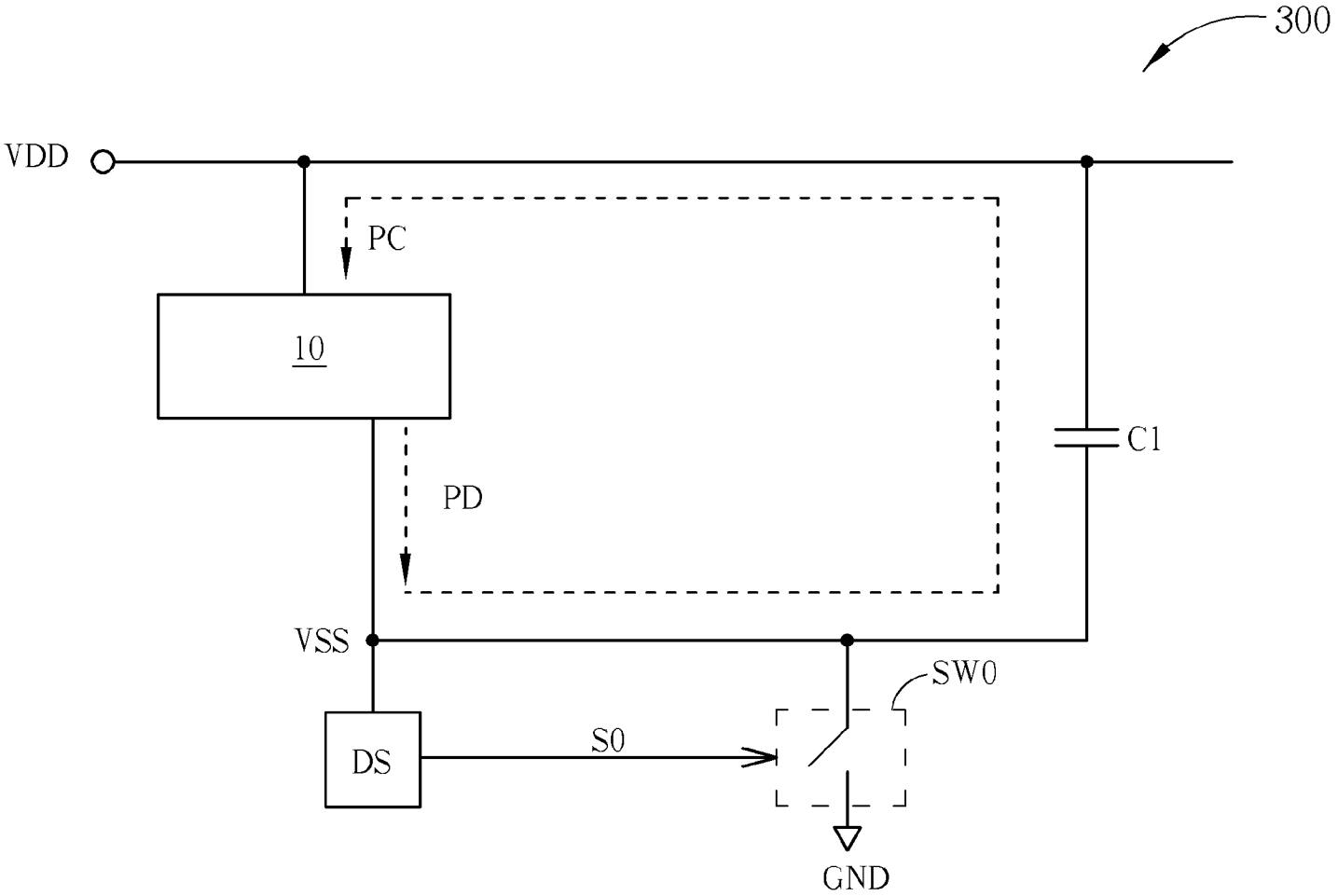
FIG. 8 is a functional diagram of a charge recycling circuit of the present invention for use in a driving circuit.

FIG. 8 is a functional diagram of a charge recycling circuit 300 for use in a driving circuit 10 according to a third embodiment of the present invention. The driving circuit 10 may be a digital circuit or an analog circuit coupled between a bias voltage VDD and a bias voltage VSS. The charge recycling circuit 300 is arranged to connect a charging path PC with a discharging path PD of the driving circuit 10 via a capacitor C1. Therefore, the charges which are discharged to the bias voltage VSS may be recycled for charging the driving circuit 10 in a subsequent period. Therefore, the power consumption of the driving circuit 10 may be lowered. The detecting circuit DS is configured to generate a control signal S0 for operating the switch SW0 according to a voltage of the node VSS or a current flowing through the node VSS.

In the charge recycling circuits 100, 200 and 300, the detecting circuit DS may be configured to generate the control signal S0 for operating the switch SW0 according to the voltage of the node VSS or the current flowing through the node VSS. Or, the detecting circuit DS may also be configured to generate the control signal S0 so that the switch SW0 may be turned on periodically.

When operating the driving circuit 10 in either full-swing or half-swing manner, the charge recycling circuit of the present invention may recycle charges during the discharging period for use in the charging period, thereby lowering the power consumption of the driving circuit 10.

The charge recycling circuit of the present invention may reduce the power consumption of the driving circuit 10 which may include a source driver of an LCD device, a digital circuit such as a timing controller or a digital signal processor (DSP), or an analog circuit such as an operational amplifier, a comparator or a phase locked loop (PLL). The type of the driving circuit 10 does not limit the scope of the present invention.

Those skilled in the art will readily observe that numerous modifications and alterations of the device and method may be made while retaining the teachings of the invention. Accordingly, the above disclosure should be construed as limited only by the metes and bounds of the appended claims.

What is claimed is:

1. A charge recycling circuit for charging a driving circuit using charges which are discharged from the driving circuit, comprising:

a first node, a second node, and a third node;

a first switch including:

a first end coupled to a first unit gain buffer of the driving circuit; and a second end;

a second switch including:

a first end coupled to a second unit gain buffer of the driving circuit; and a second end;

a third switch including:

a first end coupled to the first end of the first switch; and a second end coupled to the third node;

a fourth switch including:

a first end coupled to the first end of the second switch; and a second end coupled to the third node;

a fifth switch including:

a first end coupled to the second end of the first switch; and a second end coupled to the second node;

a sixth switch including:

a first end coupled to the second end of the second switch; and a second end coupled to the second node;

a seventh switch including:

a first end coupled to the second node; and a second end coupled to the third node;

a first capacitor including:

a first end coupled to the second end of the first switch; and a second end coupled to the third node; and a second capacitor including:

a first end coupled to the second end of the second switch; and a second end coupled to the third node.

2. The charge recycling circuit of claim 1, wherein:

the first switch is turned on by a control signal during a first period so as to electrically connect the first unit buffer to the first end of the first capacitor;

the second switch and the third capacitor are turned off by the control signal during the first period; and the fourth switch is turned on by the control signal during the first period so as to electrically connect the second unit buffer to second end of the second capacitor.

3. The charge recycling circuit of claim 2, wherein the first period is a discharging period of the first unit gain buffer and a charging period of the second unit gain buffer.

4. The charge recycling circuit of claim 2, wherein:

the fifth switch and the seventh switch are turned off by the control signal between a first time point and a second time point during the first period;

the sixth switch is turned on by the control signal between the first time point and the second time point during the first period.

5. The charge recycling circuit of claim 2, wherein:

the first switch and the fourth capacitor are turned off by the control signal during a second period;

the second switch is turned on by the control signal during the second period so as to electrically connect the second unit buffer to the first end of the second capacitor; and the third switch is turned on by the control signal during the second period so as to electrically connect the first unit buffer to second end of the first capacitor.

6. The charge recycling circuit of claim 5, wherein:

the fifth switch is turned on by the control signal between a third time point and a fourth time point during the second period; and the sixth switch and the seventh switch are turned off by the control signal between the third time point and the fourth time point during the second period.

7. The charge recycling circuit of claim 5, wherein the second period is a charging period of the first unit gain buffer and a discharging period of the second unit gain buffer.

8. The charge recycling circuit of claim 1, further comprising:

a third capacitor coupled between the first node and a second node.

* * * * *